United States Patent [19]

Perry

[11] Patent Number: 4,901,622

[45] Date of Patent: Feb. 20, 1990

[54] ARMOUR CONSTRUCTIONS

[75] Inventor: Melvyn Perry, Wetherby, England

[73] Assignee: Royal Ordnance plc, London, England

[21] Appl. No.: 130,273

[22] Filed: Dec. 8, 1987

[51] Int. Cl.[4] ..... F41H 5/04; F41H 5/16

[52] U.S. Cl. ..... 89/36.02; 89/36.17; 428/911; 109/11; 109/79

[58] Field of Search ..... 89/36.02, 36.17, 36.01, 89/36.04, 36.05; 109/26, 27, 11, 12, 13, 79, 81; 428/911

[56] References Cited

U.S. PATENT DOCUMENTS

| | | | |
|---|---|---|---|
| 985,640 | 2/1911 | Stewart | 89/36.02 |
| 2,036,903 | 4/1936 | Webster | 89/36.02 |
| 2,190,490 | 2/1940 | Sendzimir | 89/36.02 |
| 2,405,908 | 8/1946 | Mason | 109/81 |
| 3,977,294 | 8/1976 | Jahn | 89/36.02 |

FOREIGN PATENT DOCUMENTS

| | | | |
|---|---|---|---|
| 859453 | 12/1970 | Canada | 109/11 |
| 292799 | 6/1916 | Fed. Rep. of Germany | 89/36.01 |
| 631540 | 6/1936 | Fed. Rep. of Germany | 89/36.02 |
| 1127759 | 4/1962 | Fed. Rep. of Germany | 89/36.02 |
| 697878 | 9/1940 | Fed. Rep. of Germany | 89/36.02 |
| 1708495 | 1/1970 | Fed. Rep. of Germany | 109/11 |
| 2109517 | 9/1972 | Fed. Rep. of Germany | 109/79 |
| 866796 | 9/1941 | France | 89/36.02 |
| 1151196 | 1/1958 | France | 89/36.02 |

*Primary Examiner*—Charles T. Jordan
*Assistant Examiner*—Stephen Johnson
*Attorney, Agent, or Firm*—Stevens, Davis, Miller & Mosher

[57] ABSTRACT

A reactive armour construction comprises a rigidly fixed outer layer and a relatively loosely fixed inner layer mounted on a structure to be protected in such a way that when a projectile penetrates at an oblique angle the outer layer and is incident upon the inner layer, the inner layer is allowed to move laterally relative to the outer layer thereby disrupting the line of attach of the projectile.

3 Claims, 1 Drawing Sheet

ARMOUR CONSTRUCTIONS

The present invention relates to armour constructions.

Reactive armour constructions are those which defend an underlying structure such as an armoured fighting vehicle by producing by a reaction to an incoming projectile an effect which destroys the penetrative nature of the projectile.

Known reactive armours, e.g. as described in European Pat. Specification No. 0161390A1 depend largely on the use of explosive material to provide the reactive effect which enables the projectile to be defeated.

The present invention provides a novel reactive armour construction which does not depend upon the use of explosive material.

According to the present invention a reactive armour construction comprises a rigidly fixed outer layer and a relatively loosely fixed inner layer mounted on a structure to be protected in such a way that when a projectile penetrates at an oblique angle the outer layer and is incident upon the inner layer, the inner layer is allowed to move laterally relative to the outer layer thereby disrupting the line of attack of the projectile.

Preferably, the outer layer is spaced from the inner layer and the inner layer is spaced from the body to be protected.

The construction according to the invention is particularly suitable for defending structures against high kinetic energy projectiles, e.g. incorporating a heavy metal penetrator. Such projectiles are normally fired with a relatively flat trajectory and are likely to be incident on a target along a path almost parallel to the ground. Therefore, the outer and inner layers need to be arranged to be at an oblique angle to this direction of attack.

The construction according to the invention produces its reactive effect by the movement of the inner layer relative to the outer layer. If an attacking projectile penetrates the outer layer and impinges upon the inner layer the component of momentum of the projectile in a direction in which the inner layer is able to move is significant thereby causing the inner layer to move in that direction. The action of the inner and outer layers consequently resembles that of a guillotine. The line of attack of the projectile is confined generally to that of its original penetration of the outer layer by the passage formed through the outer layer. However, the movement of the inner layer produced by the projectile induces motion of the projectile in a direction parallel to the movement of the inner layer, i.e. in a direction oblique to the original line of attack, and this provides a shearing effect upon the projectile causing the projectile to be defeated.

In general, the tendency for the inner layer to move relative to the outer layer is increased as the kinetic energy of the attacking projectile increases. Therefore, the effectiveness of the projectile defeating mechanism will increase with the projectile kinetic energy.

In the construction according to the present invention the outer and inner layers in their simplest form may be homogeneous metallic layers, e.g. of armour steel plate. One or both of these layers may, alternatively, comprise a composite layer incorporating any of the materials known for use in composite engineering structures.

For example in a simple form a composite material may comprise high strength fibres or fabrics embedded within a suitable matrix. Suitable examples of high strength fibres well known in the composites art are those of aramid, polyamide, polyolefin, carbon, boron, glass and metal. Suitable high strength fabrics are well known in the composites art and are generally formed of woven fibres, for example any of the aforementioned fibres or blends or mixtures of them. Composites containing aramid fibres or fabrics are especially preferred.

The matrix in which the fibres or fabrics are preferably embedded may comprise a polymeric material or an inorganic, e.g. metal or ceramic material. Especially preferred is a laminate structure comprising alternate layers of a high strength fabric and a ceramic. The fabric may be bonded to the ceramic by any suitable adhesive as used in the composites art for the bonding of fabrics to ceramics. The laminate may be formed as one or more sandwiches of a fabric between ceramic layers or, preferably, as one or more sandwiches of a ceramic between fabric layers. Where multiple sandwiches are employed individual layers may be common to adjacent sandwiches.

A preferred composite layer comprises a laminate comprising at least one aramid fabric sub-layer and at least one ceramic sub-layer, e.g. alumina, silicon carbide or boron carbide. Such laminates are known per se, e.g. as described in UK Pat. Application Nos. GB 2,156,272A and 2,130,073A. The aramid fabric may be bonded to the ceramic by any suitable known adhesive or bonding agent, which may for example be a cold setting, thermosetting or thermoplastic material, known to be suitable for bonding aramid to ceramic.

For example, known liquid or powder adhesive may be used to bond together the fabric to the ceramic. The bonding may be by "wet-lay-up" or the layers may be in prepreg form with the adhesive activated by heat and/or other means. Contact adhesive or hot melt adhesive may be used. If desired, the adhesive may be of synthetic resin type, for example, polyester or epoxy resins. The adhesive may also be of a rubber material, for example silicone rubber. If desired the superposed layers may be subjected to pressure during bonding.

Composite layers as described may be used in conjunction with one or more metallic, e.g. armour steel, layers to form overall the outer and/or inner layer described above.

Embodiments of the present invention will now be described by way of example with reference to the accompanying drawings, in which.

Figure 1:
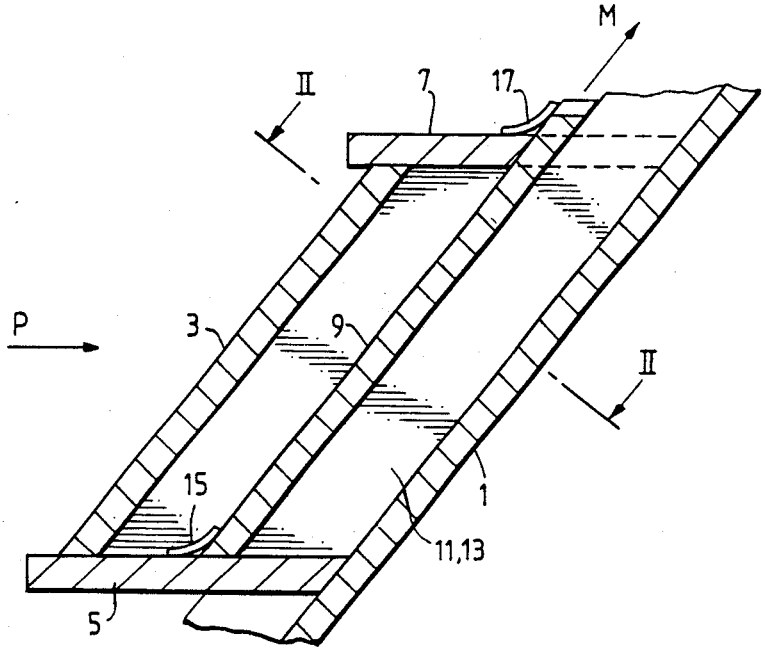
FIG. 1 is a cross-sectional side elevation of an armour construction embodying the present invention.
Figure 2:
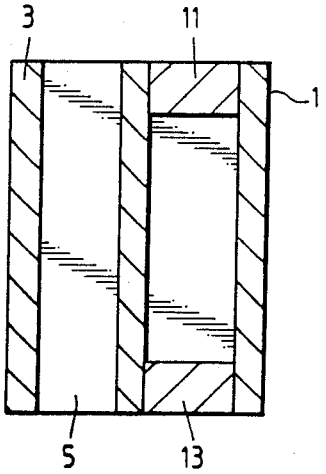
FIG. 2 is a cross-sectional view on the line II—II shown in FIG. 1 of the construction shown in FIG. 1.

In the construction shown in FIGS. 1 and 2 an outer wall 1 of a body to be protected, e.g. an armoured fighting vehicle, has rigidly fixed thereto an outer armour plate 3. The plate 3 is mounted on the wall 1 by a support shelf 5 and support arms 7 (one only shown in FIG. 1). The plate 3 may be attached to the shelf 5 and arms 7 in any suitable way, e.g. welding, bolting, as will be apparent to those skilled in the art. In the space between the outer plate 3 and the wall 1 is mounted an inner armour layer 9. The layer 9 is supported on rails 11, 13 rigidly attached to the wall 1 and is loosely attached to the shelf 5 and the arms 7 by straps 15 and straps 17 respectively.

When a projectile is incident upon the construction in an approximately horizontal direction labelled P in FIG. 1, i.e. at an acute angle to the outer plate 3, the projectile is likely to penetrate the outer plate and strike the inner plate 3.

Because the inner plate 9 is loosely mounted and is easily moved in an upward direction parallel to the rails 11, 13, as indicated by the arrow labelled M in FIG. 1, and because the attacking projectile has a high component of momentum along the direction M, the projectile causes the straps attached to the plate 9 to be broken and causes the plate 9 to move in the direction M upon impact thereon.

In moving along the direction M the plates 3 and 9 act like a guillotine, as explained above, disrupting the line of penetration of the projectile and thereby breaking up and defeating the projectile. The underlying structure of which the wall 1 is a part is thus protected against the projectile.

I claim:

1. A reactive armour construction comprising an outer armour layer rigidly fixed by support means to a structure to be protected so that said outer armour layer is spaced from said structure, an inner armour layer disposed in said space between said outer armour layer and said structure, said inner armour layer being supported on rail means rigidly attached to said structure and being relatively loosely attached to said support means by frangible connectors such that when a projectile penetrates at an oblique angle the outer armour layer and is incident upon the inner armour layer, said connectors are broken whereby said inner armour layer is allowed to move laterally upon said rail means relative to said outer armour layer thereby disrupting a line of attack of the projectile.

2. A construction as claimed in claim 1 and wherein the outer and inner layers comprise homogeneous metallic layers.

3. A construction as claimed in claim 1 wherein at least one of the said inner and outer layers comprises a composite layer incorporating a composite material.

* * * * *